US005971175A

United States Patent [19]

Bustos

[11] Patent Number: 5,971,175

[45] Date of Patent: Oct. 26, 1999

[54] DISPLAY RACK WITH MAGNETIZED WEDGE LOCK ELEMENTS

[75] Inventor: Rafael T. Bustos, Atlanta, Ga.

[73] Assignee: L&P Property Management Company, Southgate, Calif.

[21] Appl. No.: 09/189,388

[22] Filed: Nov. 10, 1998

[51] Int. Cl.[6] ..... A47B 43/00

[52] U.S. Cl. ..... 211/187

[58] Field of Search ..... 211/187, DIG. 1, 211/181.1, 182; 108/144.11

[56] References Cited

U.S. PATENT DOCUMENTS

| | | | |
|---|---|---|---|
| Re. 28,293 | 1/1975 | Bustos | 108/144 |
| 2,693,192 | 11/1954 | James | 211/DIG. 1 |
| 3,048,245 | 8/1962 | Shewell | 189/36 |
| 3,217,894 | 11/1965 | Shewell | 211/177 |
| 3,376,980 | 4/1968 | Serra | 211/148 |
| 3,523,702 | 8/1970 | Unti et al. | 287/58 |
| 3,664,274 | 5/1972 | Bustos | 108/144 |
| 4,064,995 | 12/1977 | Bustos | 211/187 |
| 4,230,052 | 10/1980 | Champagne | 108/144 |
| 4,582,001 | 4/1986 | Leikarts | 108/106 |
| 4,593,826 | 6/1986 | Bustos | 211/187 |
| 4,637,323 | 1/1987 | Nicely | 211/187 |
| 4,677,780 | 7/1987 | Shuman | 211/DIG. 1 |
| 4,754,712 | 7/1988 | Olson et al. | 108/111 |
| 4,763,579 | 8/1988 | Cibulak | 108/48 |
| 4,811,670 | 3/1989 | Kolvites et al. | 108/107 |
| 4,815,394 | 3/1989 | Ettlinger et al. | 108/111 |
| 4,852,501 | 8/1989 | Olson et al. | 108/111 |
| 4,905,847 | 3/1990 | Hanson | 211/DIG. 1 |
| 5,531,332 | 7/1996 | Monnens | 211/DIG. 1 |
| 5,669,516 | 9/1997 | Horn | 211/DIG. 1 |
| 5,676,263 | 10/1997 | Chang | 211/187 |
| 5,779,070 | 7/1998 | Dickinson et al. | 211/187 |

*Primary Examiner*—Alvin Chin-Shue
*Assistant Examiner*—Sarah Purol
*Attorney, Agent, or Firm*—Wood, Herron & Evans, L.L.P.

[57] ABSTRACT

A display rack is provided in which a plurality of shelves are mounted in at desired locations along vertical corner posts by magnetized wedge lock elements. Each wedge lock element is of a one-piece construction having an outwardly extending projection adapted to seat within a dimple or detent vertically spaced along a surface or corner of the corner posts. The shelves are formed with a sleeve at each corner adapted to fit over the corner posts and into engagement with the wedge lock elements. The wedge lock elements become wedged between the corner posts and sleeves to prevent downward vertical movement of the shelves relative to the corner posts while permitting easy adjustment of the shelves by moving the magnetized wedge locks to a new position along the corner posts.

25 Claims, 3 Drawing Sheets

DISPLAY RACK WITH MAGNETIZED WEDGE LOCK ELEMENTS

FIELD OF THE INVENTION

This invention relates to adjustable display racks, and more particularly, to a magnetized wedge-locking arrangement for adjustably mounting a shelf vertically along the corner posts of a display rack.

BACKGROUND OF THE INVENTION

Display racks for merchandising and other display purposes having shelves that are vertically adjustable along the corner posts are well-known in the art. Vertically adjustable shelves provide flexibility in the display of different sized articles, allowing merchandisers to use the same display rack for a variety of articles.

Early designs of adjustable display racks employed set screws or bolts to connect the corner posts and shelves. Threaded bores or apertures were formed in either the shelf or corner posts, or both, and the bolts or screws were tightened within the threaded bores to secure the shelves in place at spaced locations along the corner posts. Although this design provides for adjustment of the shelves vertically along the corner posts, an inordinate amount of time is required to remove all of the bolts connecting each shelf to a corner post and then reposition them to other locations along the corner posts. In addition, the threaded connections are subject to being over or under tightened, and as a result, the threads formed in either the bolt or threaded bores in the shelf or corner post can become worn.

In an effort to lessen the time required to adjust the location of shelves along the corner posts of a display rack, and to provide a connection between the corner posts and shelves that is less susceptible to wear, corner post-shelf connections employing a wedge lock element have been developed, as shown for example in U.S. Pat. Nos. 3,424,111 and 3,343,685. In designs of this type, a sleeve is formed in each corner of the shelf structure, which is adapted to receive a corner post. A wedge-shaped locking element or insert is adapted to mount at desired vertical locations along each of the corner posts before the shelves are moved into place. A shelf is releasably mounted to the corner posts by moving the sleeves of the shelf vertically downwardly along the corner posts and into contact with the wedge-shaped inserts. The insert becomes wedged between the sleeve and corner post preventing further downward movement of the shelf there along. Adjustment of the location of the shelf is accomplished by lifting vertically upwardly on the shelf so that the sleeves disengage the inserts, and then placing the inserts at another desired location along the corner posts.

The wedge-type connections between the shelves and corner posts of known display racks have proved to be both durable and quickly adjustable for disassembly of the display rack or repositioning of the shelves. Nevertheless, certain disadvantages are present in the construction of the wedge-shaped inserts and in their connection to the corner posts. For example, in U.S. Pat. No. 3,424,111, the wedge-shaped inserts are formed in two separate pieces which are connected to one another by a spring clip. A second spring clip is required to locate and mount the assembled wedge-shaped inserts in the proper positions along the corner posts in preparation for receiving the shelves. This design increases the number of pieces required for assembly of the inserts, and for mounting them to the corner posts, which adds to manufacturing costs and increases the difficulty of initially mounting the shelves and then moving them from one position along the corner posts to another.

In U.S. Pat. No. 3,664,274, a V-shaped wedge lock element is utilized having a tongue protrusion extending from the inner surface of one face of the wedge lock element, which hooks into a slot on the corner post, to prevent the wedge lock from falling off of the corner post and to locate the height of the shelving on the corner post. U.S. Pat. No. 4,593,826 describes a V-shaped wedge lock element of a two-piece construction interconnected by a tongue and groove arrangement. Each face of the two-piece construction includes an extending projection that engages with detents or dimples on the side faces of the square corner posts. Each of the two pieces have flanges at the ends of the perpendicular walls that extend around the corners of the corner posts, such that a portion of the wedge lock is in contact with all four sides of the square corner post, serving to keep the wedge lock from falling off of the corner post. U.S. Pat. Nos. 4,754,712 and 4,852,501 describe V-shaped wedge lock elements having a protrusion in the corner of the wedge lock element that fits into one of a plurality of notches on the corner edge of the corner post. The '712 and '501 Patents also include retaining flanges to prevent the wedge lock element from falling off of the corner post.

SUMMARY OF THE INVENTION

The present invention provides a one-piece magnetized wedge lock element that is easily positioned on and secured to a corner post of an adjustable display rack, for positioning a shelf at a particular height on the corner post. The adjustable display rack of the present invention utilizes a corner post having a plurality of spaced dimples or detents along the length of the corner post and a wedge lock element having a protrusion that is adapted to seat within the detent of the corner post. The magnetization of the wedge lock element secures the element to the corner post for subsequent positioning of the shelf over the wedge lock element. For adjusting the height of the shelving, the shelf is simply lifted vertically upward and the wedge lock element is repositioned and secured at a different vertical location on the corner post. Thus, the present invention provides an adjustable display rack having a simple means for adjusting the height of the shelving, wherein the means is easily manufactured and durable.

These and other objects and advantages of the present invention shall become more apparent from the accompanying drawings and description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Figure 1:
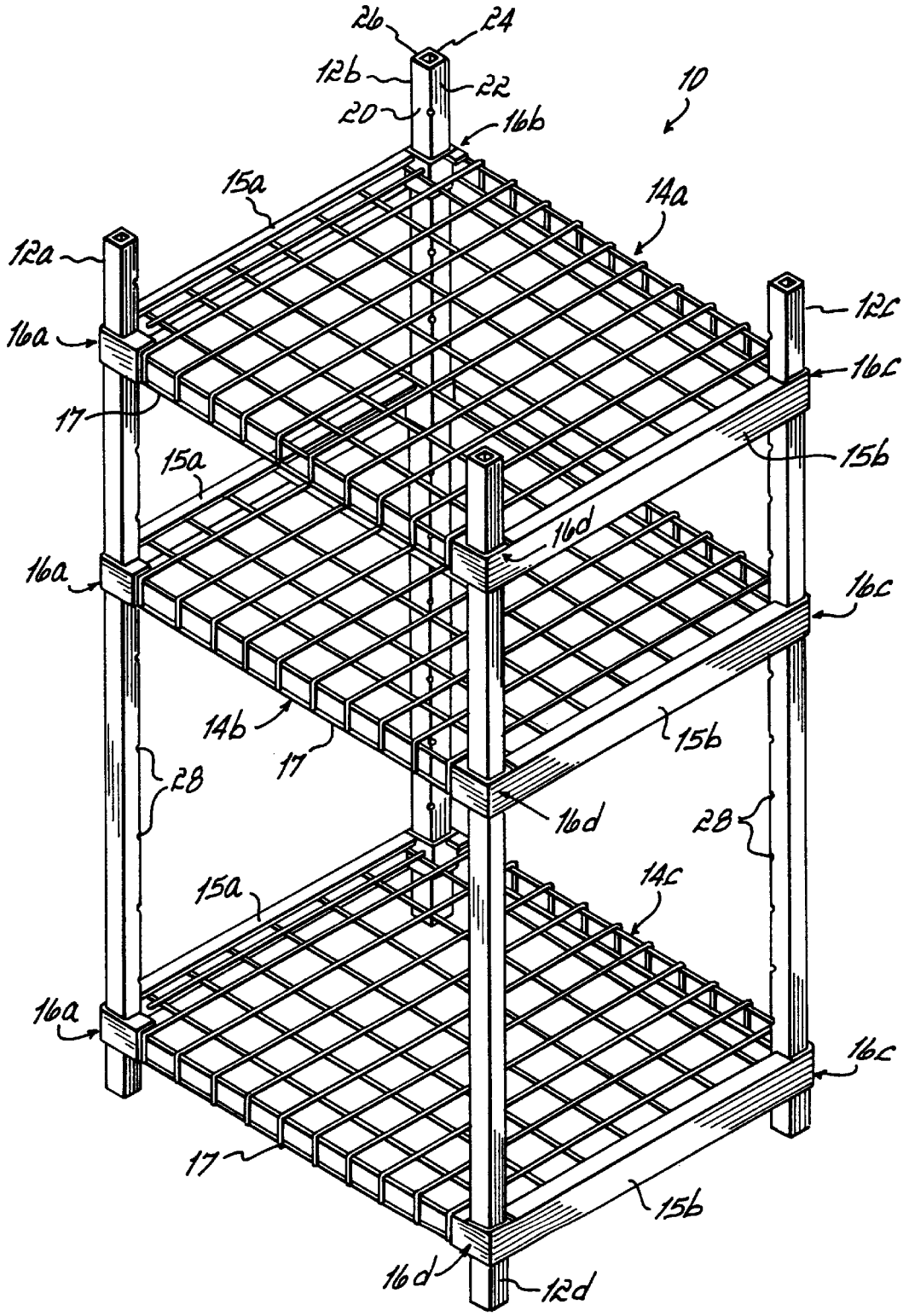
FIG. 1 is a perspective view of a display rack incorporating the shelf-corner post connection of this invention.
Figure 2:
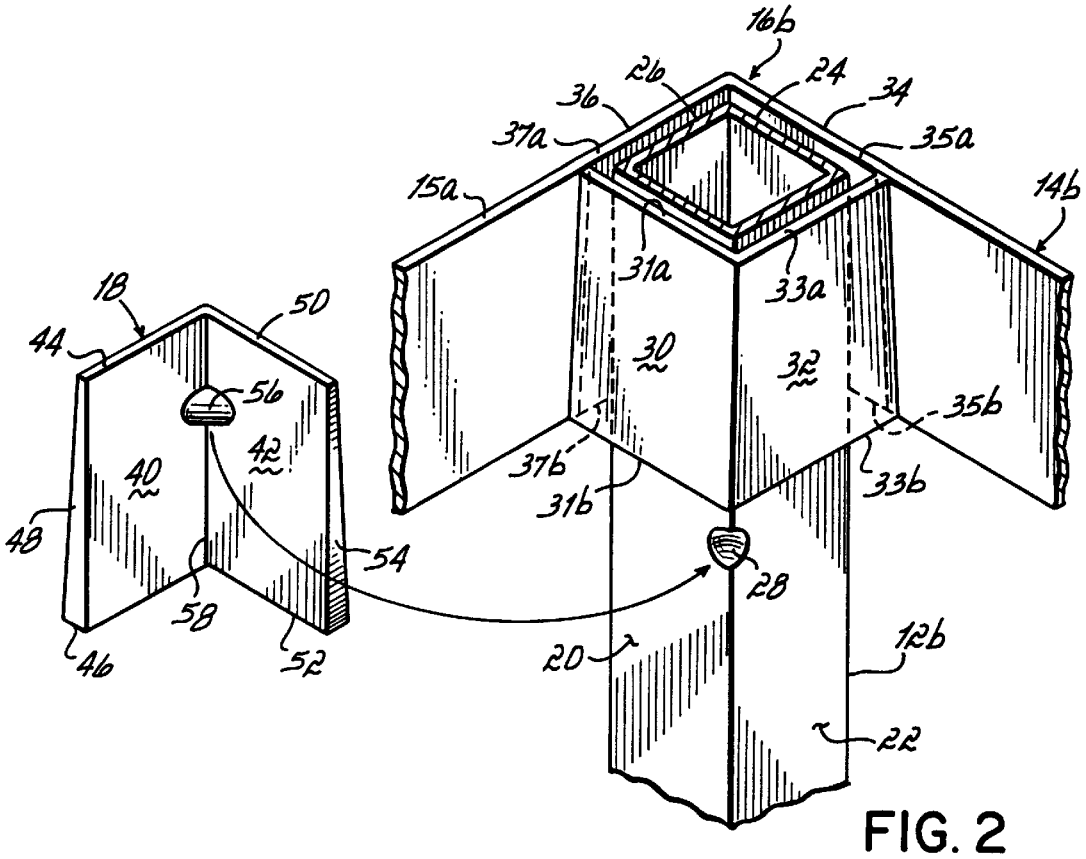
FIG. 2 is an enlarged exploded, partial perspective view of the connection between one embodiment of the wedge lock element and a corner post.
Figure 3:
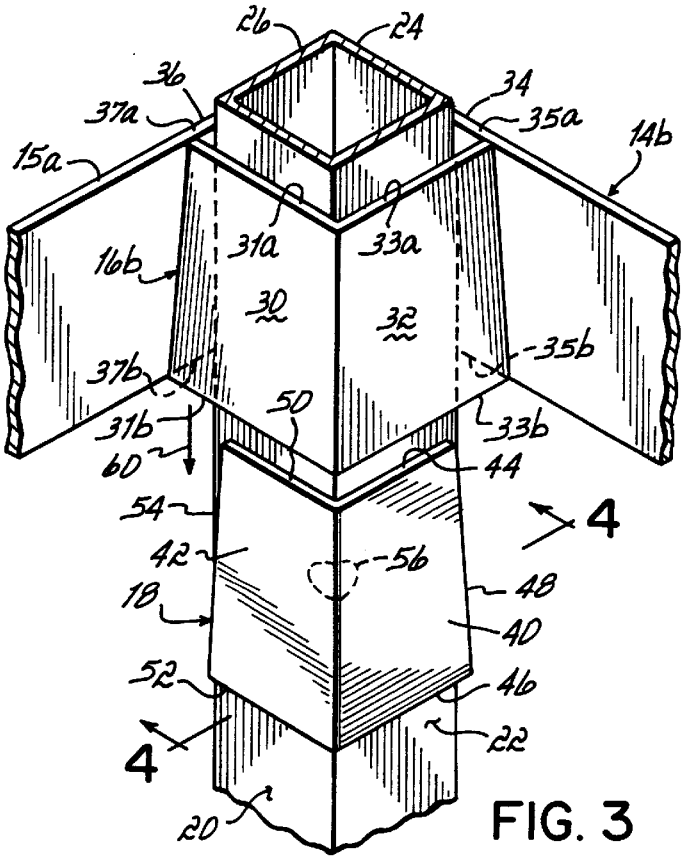
FIG. 3 is a partial perspective view of a portion of a shelf structure disposed along a corner post just prior to engagement with the wedge lock element of the embodiment shown in FIG. 2.

Referring now to the drawings, FIG. 1 shows a display rack 10 that includes four corner posts 12*a*–12*d* adapted to support shelves 14*a*–14*c*. Each shelf is formed with sleeves 16*a*–16*d* at the corners which are adapted to receive corner posts 12*a*–12*d*, respectively. The shelves 14*a*–14*c* are supported at desired vertical locations along corner posts 12*a*–12*d* by wedge lock elements 18 releasably mounted to each of the corner posts 12*a*–12*d*, as shown in FIGS. 2 and 3. As discussed below, the corner post-receiving elements or sleeves 16*a*–16*d* of each shelf 14*a*–14*c* are adapted to engage the wedge lock elements 18, which form a wedge between the sleeves 16*a*–16*d* and corner posts 12*a*–12*d* to prevent downward movement of the shelves 14*a*–14*c* along the corner posts 12*a*–12*d*. The shelves 14*a*–14*c* are removed from the corner posts 12*a*–12*d* for disassembly or repositioning by lifting them vertically upwardly from the wedge lock elements 18.

As shown in FIGS. 1, 2 and 3, each corner post may have a square cross-sectional configuration with four faces or sides 20, 22, 24, 26. A plurality of detents or dimples 28 are spaced along the length of each corner post 12*a*–12*d* at a corner between two adjacent sides, such as between adjacent sides 20, 22 as shown in FIG. 1. Each dimple 28 formed in corner post 12*a* lies in generally the same horizontal plane with a dimple formed in each of corner posts 12*b*–12*d*. The corner post 12 may be deformed to create the plurality of dimples, or bores may be created through the corner post material. As discussed in detail below, the dimples 28 function to locate the wedge lock elements 18 at a desired vertical location on the corner posts 12*a*–12*d*.

Figure 4:
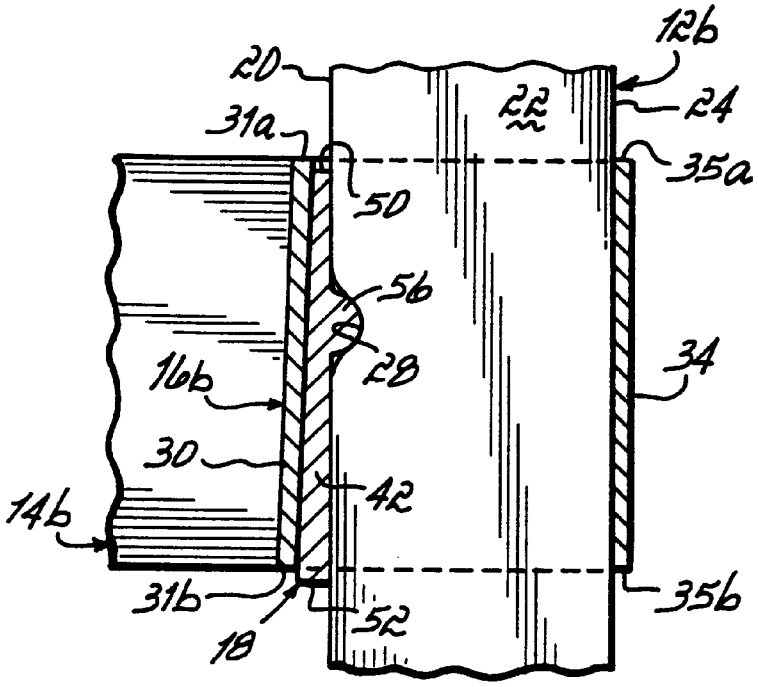
FIG. 4 is a cross-sectional view taken generally along line 4—4 of FIG. 3 after engagement of the sleeve with its wedge lock and corner post.
Figure 5:
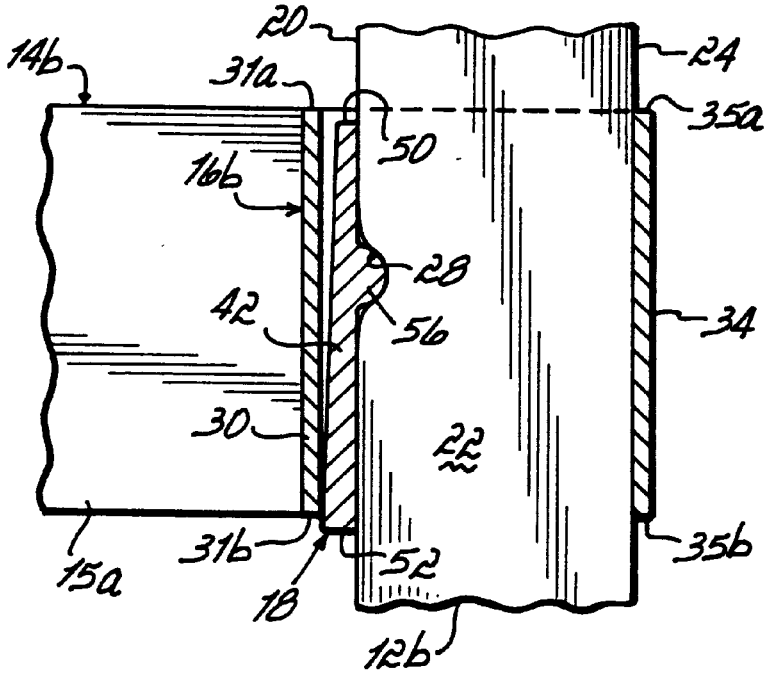
FIG. 5 is a cross-sectional view of an alternative embodiment of the present invention.

In the embodiment shown in FIG. 1, each shelf 14*a*–14*c* includes spaced side panels 15*a*, 15*b* and a cross wire support surface 17 that extends between and is mounted to the side panels 15*a*, 15*b* by welding or brazing. The corner post-receiving elements or sleeves 16*a*–16*d* are mounted to or integrally formed at the ends of side panels 15*a*, 15*b*, which form the four corners of shelves 14*a*14*c*, with sleeves 16*a*, 16*b* being disposed at opposite ends of side panel 15*a* and sleeves 16*c*, 16*d* being disposed at opposite ends of panel 15*b*. Alternatively, the shelves may be provided with panels on each of the four sides, or no panels on any side, as long as a sleeve or corner post-receiving structure is present in each corner. In the embodiment shown in FIGS. 2–4, each sleeve 16*a*–16*d* includes sides 30, 32, 34, 36, each side with an inner surface, the four inner surfaces forming the opening through which the corner post 12 is inserted. Two or more of the inner surfaces of sides 30, 32, 34, 36 may be tapered such that the opening is smaller at the top edges 31*a*, 33*a*, 35*a*, 37*a*, respectively, of the sides of the sleeve than the opening at the bottom edges 31*b*, 33*b*, 35*b*, 37*b*, respectively, of the sides of the sleeve. Two of the sides may also be joined to the other two sides or to two side panels at an angle to achieve the same effect. Advantageously, the two sides at the interior of the shelf are angled or tapered, while the outer two sides are straight so as to provide a consistent outer appearance to the display rack. In an alternative embodiment shown in FIG. 5, the sleeves 16*a*–16*d* are formed with the inner surfaces of sides 30, 32, 34, 36 having no taper so that the sleeves 16*a*–16*d* are substantially square in configuration. As discussed below, the sleeves 16*a*–16*d* of either embodiment are each adapted to receive a wedge lock element 18 that wedges between the corner posts 12*a*–12*d* and sleeves 16*a*–16*d* to secure the shelves 14 along the corner posts 12*a*–12*d*.

Referring now to FIG. 2, the wedge lock element 18 in one embodiment of this invention is of a one-piece construction having two side walls 40, 42 opposed by 90°. The first side wall 40 includes top and bottom edges 44, 46 and a side edge 48, and the second side wall 42 includes top and bottom edges 50, 52 and a side edge 54. Each side wall 40, 42 of the wedge lock element 18 tapers outwardly from top to bottom so that the cross-sectional area at the top edges 44, 50 is less than the cross-sectional area at the bottom edges 46, 52. Advantageously, for every 2 inches of height, there is a 0- to ⅛-inch variance in the thickness. Thus, for a 2-inch wedge lock element, there is approximately a 1° taper from top to bottom.

The wedge lock element 18 may include an outwardly extending stud or projection 56. This projection 56 extends from the interior corner 58, which is at the juncture of side walls 40 and 42. The projection 56 of the wedge lock element 18 and the dimples 28 formed in the corner of corner posts 12*a*–12*d* provide a means for locating the wedge lock elements 18 in the desired vertical position along the corner posts 12*a*–12*d*. The projection 56 of the wedge lock element need not be sufficient to releasably mount the wedge lock element to the corner post 12 when the shelf 14 is not in position. Rather, wedge lock elements 18 are magnetized for securing the elements to the corner posts 12*a*–12*d*. Thus, the projection 56 seats within the dimple 28 formed in the corner of the corner post 12 to locate the shelf at the desired vertical position and to prevent the shelves from being positioned unevenly on the four corner posts 12*a*–12*d*, while the magnetization of the wedge lock element 18 serves to secure the wedge lock element 18 to the corner post when shelf 14 is not in position or engaged with the wedge lock elements 18. Alternatively, the wedge lock element 18 may be formed without the projection 56, in which case, the corner post will not need the dimples 28. The wedge lock element still releasably mounts to the corner post without the benefit of this particular locating means. Alternative locating means may be used or no means at all other than bare eyesight. The purpose of the locating means is merely to provide an accurate means for positioning the shelf at an exact desired height on the corner post.

The strength of magnetization of the wedge lock element 18 is strong enough to hold the element in place, but not so strong that wedge lock element 18 cannot be easily removed from the corner post 14 when it is desired to reposition the height of the shelf 14. The wedge lock element of the present invention is preferably made of magnetized plastic, such as magnetic high density polypropylene or PVC. The plastic material may be provided with magnetic properties by adding ferrous filings, or minute pieces of metal, to the plastic material to form a homogeneous suspension, followed by passing the material through a magnetic field to charge it. The material then possesses a consistent degree of magnetism for the life of the material, much the same as the material used for refrigerators. The strength of the magnetization of wedge lock element 18 prevents slippage of the wedge lock element and therefore the shelf. The optional projection 56 may provide additional security against slippage. The outward taper of the wedge lock element 18 ensures a tight wedge between sleeve 16 and corner post 12.

Referring to FIGS. 1–3, the connection between the sleeve element 16*b* of shelf 14*b* and a wedge lock element 18 mounted to corner post 12*b* is shown to illustrate the wedge lock mounting feature of this invention. Each corner of shelves 14*a*–14*c* is mounted along a corner post 12*a*–12*d* in the same manner. The shelf 14*b* is positioned so that its sleeve element 16*b* aligns with the corner post 12*b*, and then travels vertically downwardly with the corner post 12*b* moving within the sleeve element 16*b*. At the location where the wedge lock element 18 is mounted to corner post 12*b*, the sleeve element 16*b* initially slides over the top edges 44, 50 of wedge lock element 18 (as shown by arrow 60 in FIG. 3), but then engages the wedge lock element 18 as its cross-sectional area increases towards the bottom edges 46, 52. Further downward movement of the shelf 14*b* is prevented because the wedge lock element 18 becomes wedged between sleeve elements 16*b* and corner post 12*b*. This occurs where the thickness of the wedge lock element 18 is equal or greater to than the space between the corner post 12*b* and sleeve element 16*b*. Where two of the sides of the sleeve have been tapered or angled, the wedge lock element is placed on the corner post such that it will be in contact with those sides of the sleeve. As previously stated, the interior sides of the sleeve are angled, and so the wedge lock element 18 is placed on interior faces 20, 22 of the corner post 12.

The wedge lock element of the present invention has been described as a V-shaped element having 90° opposed side walls for use with a square corner post. It is to be understood, however, that the wedge lock element may vary in shape for use with various geometrically shaped corner posts. For example, for corner posts having at least three sides, the wedge lock element has two side walls adapted to releasably mount, by magnetization, to two adjacent sides of the corner post. The angle of degree between the opposing side walls will vary depending on the number of sides on the corner post. The optional dimples of the corner post are formed in the corner of the two adjacent sides, and the optional projection of the wedge lock element extends outwardly from the juncture of the two side walls. For a round or oval corner post, the wedge lock element is an arc, such that the wedge lock element partially surrounds the corner post when mounted thereon. Thus, the magnetized wedge lock of the present invention may be adapted for use with any shaped corner post.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. An adjustable display rack comprising:

a shelf having a corner post-receiving element at each corner;

corner posts for supporting the shelf, each of the corner posts being adapted to extend through one of the corner post-receiving elements of the shelf;

a one-piece wedge lock element partially surrounding each corner post and adapted to wedge between the corner post and the corner post-receiving element at each corner of the shelf for supporting the shelf along the corner posts, wherein the wedge lock element is magnetized to secure the wedge lock element to the corner post.

2. The display rack of claim 1, wherein the wedge lock element is made of plastic material with small metal pieces dispersed throughout.

3. The display rack of claim 2, wherein the plastic material is polypropylene or PVC.

4. The display rack of claim 3, wherein the metal pieces are iron.

5. An adjustable display rack, comprising:

a shelf having a sleeve element mounted at each corner;

corner posts for supporting the shelf, each having a plurality of spaced dimples, and each of the corner posts being adapted to extend through one of the sleeve elements of the shelf; and a one-piece wedge lock element partially surrounding each corner post and adapted to wedge between the corner post and the sleeve element at each corner of the shelf for supporting the shelf along the corner posts;

wherein the wedge lock element includes an outwardly extending projection adapted to seat within a dimple on the corner post to vertically position the shelf on the corner post, and the wedge lock element is magnetized to secure the wedge lock element to the corner post.

6. The display rack of claim 5, wherein the sleeve element has a top edge, a bottom edge, and an inner surface, and the diameter at the inner surface increases from the top edge to the bottom edge; and wherein the wedge lock element has a top edge, a bottom edge and side edges, the wedge lock element increasing in cross section from the top edge to the bottom edge.

7. The display rack of claim 5, wherein the corner posts are of a geometric shape consisting of at least three sides and the spaced dimples are formed in a corner of the corner post.

8. The display rack of claim 7, wherein the wedge lock element has two side walls adapted to secure to two adjacent sides of the corner post, the projection of the wedge lock element extending from a juncture of the two side walls.

9. The display rack of claim 5, wherein the corner posts are round.

10. The display rack of claim 9, wherein the wedge lock element is an arc adapted to secure to a portion of the corner post.

11. An adjustable display rack, comprising:

a shelf having a sleeve element mounted at each corner;

corner posts for supporting the shelf, each of the corner posts being adapted to extend through the sleeve elements of the shelf;

a wedge lock element partially surrounding each corner post and including top, bottom and side edges, the wedge lock element increasing in cross section from the top edge to the bottom edge, and the wedge lock element being magnetized to secure the wedge lock element to the corner post;

locating means for locating the wedge lock element along the corner post, the locating means including a plurality of spaced dimples formed in the corner post, and a projection extending outwardly from the wedge lock element, the projection of the wedge lock element being adapted to seat within the dimples formed within the corner post for locating the wedge lock element along the corner post;

the wedge lock element being adapted to wedge between the sleeve element at each corner of the shelf and the corner post for supporting the shelf along the corner posts, the wedge lock element preventing downward movement of the shelf along the corner posts while permitting the shelf to be lifted vertically upward from the wedge lock element along the corner posts for repositioning the shelf.

12. The display rack of claim 11, wherein the sleeve element has a top edge, a bottom edge, and an inner surface, and wherein the diameter at the inner surface increases from the top edge to the bottom edge.

13. The display rack of claim 11, wherein the corner posts are square and the spaced dimples are formed in a corner of the corner post.

14. The display rack of claim 13, wherein the wedge lock element is a one-piece structure including two side walls adapted to secure to two adjacent sides of the corner post, the projection of the wedge lock element extending from a juncture of the two side walls.

15. The display rack of claim 11, wherein the corner posts are rectangular and the spaced dimples are formed in a corner of the corner post.

16. The display rack of claim 15, wherein the wedge lock element is a one-piece structure including two side walls adapted to secure to two adjacent sides of the corner post, the projection of the wedge lock element extending from a juncture of the two side walls.

17. The display rack of claim 11, wherein the corner posts are round.

18. The display rack of claim 17, wherein the wedge lock element is a one-piece structure having a curved wall adapted to secure to a portion of the corner post.

19. The display rack of claim 11, wherein the corner posts are triangular.

20. The display rack of claim 19, wherein the wedge lock element is a one-piece, V-shaped structure including two side walls adapted to secure to two adjacent sides of the corner post, the projection of the wedge lock element extending from a juncture of the two side walls.

21. An adjustable display rack, comprising:

a shelf having a sleeve element mounted at each corner, the sleeve element having four side walls, each having a top edge, a bottom edge, and an inner surface, wherein the distance between opposing inner surfaces increases from the top edge to the bottom edge;

corner posts for supporting the shelf, each of the corner posts having four sides, and each corner post being adapted to extend through one of the sleeve elements of the shelf;

a one-piece wedge lock element partially surrounding each corner post and including two side walls, each having a top, bottom and side edge, and an interior corner, the side walls increasing in cross section from the top edge to the bottom edge, and the wedge lock element being magnetized to secure the wedge lock element to two adjacent sides of the corner post;

locating means for locating the wedge lock element along the corner post, the locating means including a plurality of spaced dimples formed in a corner of the corner post, and a projection extending outwardly from the interior corner of the wedge lock element, the projection of the wedge lock element being adapted to seat within the dimples formed within the corner of the corner post for locating the wedge lock element along the corner post;

the wedge lock element being adapted to wedge between the sleeve element at each corner of the shelf and the corner post for supporting the shelf along the corner posts, the wedge lock element preventing downward movement of the shelf along the corner posts while permitting the shelf to be lifted vertically upward from the wedge lock element along the corner posts for repositioning the shelf.

22. An adjustable display rack comprising:

a shelf having a corner post-receiving element at each corner;

a plurality of corner posts for supporting the shelf, each of the corner posts extending through one of the corner post-receiving elements of the shelf;

a one-piece wedge lock element attached to each corner post and wedged between the corner post and the corner post-receiving element at each corner of the shelf for supporting the shelf along the corner posts, wherein the wedge lock element is magnetized to attach the wedge lock element to the corner post.

23. The display rack of claim 22, wherein the wedge lock element has a top and a bottom, and the thickness of the wedge lock element varies from 0 inch to approximately ⅛ inch from the top toward the bottom for every 2 inches of height.

24. The display rack of claim 23, wherein the wedge lock element has no variance in thickness from the top to the bottom.

25. The display rack of claim 23, wherein the wedge lock element has about a 1° taper from the top to the bottom.

* * * * *